US005707194A

United States Patent [19]

Blumberg et al.

[11] Patent Number: 5,707,194

[45] Date of Patent: Jan. 13, 1998

[54] BINDING OF CALENDARS

[75] Inventors: Murray Basil Blumberg, Gauteng, South Africa; William M. Hoffman, Hamilton, Ohio

[73] Assignee: Press Engineering (Proprietary Limited), Ophirton, South Africa

[21] Appl. No.: 432,789

[22] Filed: May 2, 1995

[51] Int. Cl.[6] ..... B42B 5/08

[52] U.S. Cl. ..... 412/38; 412/39; 412/9

[58] Field of Search ..... 72/178, 182, 131, 72/404; 412/9, 16, 19, 20, 22, 17, 18, 33, 34, 37; 29/417, 33.5, 33 E, 243.5, 33.52, 33 K, 33 Q, 564.8, 564.1, 564.6; 493/439, 438, 443, 446, 455

[56] References Cited

U.S. PATENT DOCUMENTS

| | | | |
|---|---|---|---|
| 1,057,295 | 3/1913 | Stuebing, Sr. . | |
| 1,906,024 | 4/1933 | Todd . | |
| 2,042,912 | 6/1936 | Stuebing, Jr. . | |
| 2,050,241 | 4/1936 | Gray et al. | 72/178 |
| 2,690,781 | 10/1954 | Hall | 29/33.52 |
| 2,749,961 | 6/1956 | Czarnik | 29/33.5 |
| 2,912,038 | 11/1959 | Harper | 72/178 |
| 3,659,330 | 5/1972 | De Villier et al. | 29/564.8 X |
| 3,946,919 | 3/1976 | Ernst | 226/11 |
| 4,130,933 | 12/1978 | Demrick | 29/33.5 X |
| 4,151,037 | 4/1979 | Klingelhoefer et al. | 156/522 X |
| 4,365,492 | 12/1982 | Kortan et al. | 72/131 X |
| 5,364,215 | 11/1994 | Snellman et al. | 412/4 X |
| 5,496,253 | 3/1996 | Snellman et al. | 281/21.1 X |

*Primary Examiner*—Willmon Fridie, Jr.
*Attorney, Agent, or Firm*—Wood, Herron & Evans, L. L. P.

[57] ABSTRACT

A method of manufacturing a binding strip includes the step of providing a length of metal strip from a supply thereof. The length of metal strip is folded about a first fold line parallel to a longitudinal axis thereof to form two portions angularly disposed to each other about the first fold line. The invention extends to a method of binding a calendar which includes the step of providing a length of metal strip from a supply thereof. The metal strip is folded about a first fold line parallel to a longitudinal axis thereof to form two portions angularly disposed to each other about the first fold line. An end of the calendar is located in a region between the portions and secured between the two portions. The invention extends further to an apparatus for manufacturing a binding strip and to an apparatus for binding a calendar.

17 Claims, 8 Drawing Sheets

BINDING OF CALENDARS

FIELD OF THE INVENTION

This invention relates to the binding of calendars. More particularly, this invention relates to a method of, and an apparatus for, manufacturing a binding strip and to a method of, and an apparatus for, fastening a binding strip to a calendar.

BACKGROUND OF THE INVENTION

Binding strips for calendars are presently manufactured from metal sheets. The method which is presently utilised includes cutting the strip from a sheet of metal prior to forming the strip.

There are a number of disadvantages associated with using sheets of metal. Calendars are, by nature, extremely varied and can therefore have any width depending on a customer's requirements. Sheets of metal are usually supplied in standard sizes. It follows, therefore, that a user may never be able to obtain the correct sheet width. This means that the sheets may have to be cut to size before manufacture of the binding strip. It will be appreciated that this could greatly increase the cost of manufacture of the binding strips. Further, there could be a significant amount of wastage.

Instead of cutting each sheet to size, a user could keep a number of differently sized sheets in stock. A disadvantage of this is that a user will be burdened with increased storage space and increased raw material costs and may still not have sheets of the necessary dimensions.

SUMMARY OF THE INVENTION

According to a first aspect of the invention, there is provided a method of manufacturing a binding strip, the method including the steps of providing a length of metal strip from a supply thereof; and folding the length of metal strip about first fold line parallel to a longitudinal axis thereof to form two portions angularly disposed to each other about the first fold line.

The method may include roll-forming the length of metal strip.

The metal strip may be roll-formed in a number of stages so that an included angle between the portions decreases at each stage until a required angle is obtained.

The strip may be supplied continuously from a roll of the strip.

The strip may be parted once a required length of the folded strip has been formed, or prior to folding.

According to a second aspect of the invention, there is provided a method of binding a calendar which includes the steps of:

providing a length of metal strip from a supply thereof;

folding the length of metal strip about a first fold line parallel to a longitudinal axis thereof to form two portions angularly disposed to each other about the first fold line;

locating an end of the calendar to be bound in a region between the portions; and displacing the end and the two portions towards each other so that the end is secured between the two portions.

The method of binding a calendar may include roll-forming the length of metal strip. It may also include roll-forming the metal strip in a number of stages so that an included angle between the portions decreases at each stage until a required angle is obtained. Also, the strip may be supplied continuously from a roll of the strip and the strip may be parted once a required length of the folded strip has been formed, or prior to folding.

In this specification, the word "crimp" is to be understood to mean bending the two portions with the end of the calendar therebetween so that the end is folded over within the portions.

The method of binding may include crimping the end and the two portions together to lock the end between the two portions.

According to a third aspect of the invention there is provided a method of binding a calendar which includes the steps of:

providing a partially folded over binding strip having two portions angularly disposed about a fold line;

mating the binding strip and an end of the calendar, with the end of the calendar located in a region between the portions; and securing the end between the two portions, by rolling.

The end of the calendar and the two portions may be secured together by clamping the end and the two portions together in a series of rolling operations.

The portions and the end of the calendar may be crimped together by being folded about a further fold line parallel to a longitudinal axis of one of the portions.

The methods of binding according to the second and third aspects of the invention may include roll forming the two portions, with the end of the calendar therebetween, in a number of stages so that the two portions and the end are gradually folded over.

According to a fourth aspect of the invention, there is provided an apparatus for manufacturing a binding strip, the apparatus including a supply means for supplying metal strip from a roll thereof; and a folding means for folding the length of metal strip about a first fold line parallel to a longitudinal axis thereof to form two portions angularly disposed to each other along the first fold line.

The folding means may comprise a roller assembly. The roller assembly may include a number of consecutively arranged roller sets, for successively bending the two portions in stages until the required angle between the two portions is obtained. Each roller set may have a pair of rollers rotatable about a pair of parallel first axes for gripping one of the portions, and a forming roller, having an axis of rotation which is angularly disposed to the first axes, for bearing against a surface of the other portion.

The supply means may include a roll of metal strip and a pair of feed rollers for feeding the strip from the roll into a first roller set.

The binding strip manufacturing apparatus may include a reciprocating cutter for parting the strip when a desired length of the folded strip has passed out of a last roller set, or prior to folding.

According to a fifth aspect of the invention there is provided an apparatus for binding a calendar, the apparatus including a supply means for supplying a metal strip from a roll thereof;

a folding means for folding the length of metal strip about a first fold line parallel to a longitudinal axis thereof to form two portions angularly disposed to each other along first fold line;

a securing means for securing the portions to the calendar; and a feed means, which defines a calendar feed path and a binding strip feed path, the calendar feed path and the binding strip feed patch being located in the same plane, for feeding the calendar and the binding strip into the crimping device.

The folding means of the binding apparatus may also comprise a first roller assembly. The first roller assembly may include a number of consecutively arranged roller sets, for successively folding the two portions in stages until the required angle between the two portions is obtained.

Each such roller set may have a pair of rollers rotatable about a pair of parallel first axes for gripping one of the portions and a forming roller, having an axis of rotation which is angularly disposed to the first axes, for bearing against a surface of the other portion.

The supply means may include a roll of metal strip and a pair of feed rollers for feeding the strip from the roll into a first roller set.

The binding apparatus may include a reciprocating cutter for parting the strip when a desired length of the folded strip has passed out of a last roller set, or prior to folding.

The securing means may be in the form of a second roller assembly. The second roller assembly may include a number of consecutively arranged clamping roller sets, for successively displacing the portions towards each other to clamp an end of a calendar to be bound therebetween.

The second roller assembly may also include a number of consecutively arranged crimping roller sets for successively bending the portions, with the end therebetween, to crimp the portions and the end together.

According to a sixth aspect of the invention there is provided an apparatus for binding a document, the apparatus including a supply means for supplying a partially folded over binding strip having two portions angularly disposed about a fold line;

a mating means for mating the binding strip and an end of the document, with the end of the document located in a region between the portions;

a roller assembly for successively displacing the portions towards each other to secure the end of the calendar therebetween.

The feed means and mating means may include a calendar feed mechanism for feeding the end of the calendar into a region between the portions prior to the portions being folded towards each other.

The roller assembly for the binding apparatus in accordance with the sixth aspect may include a number of consecutively arranged clamping roller sets for roll-forming the two portions, with the end of the document therebetween, in a number of stages so that the end is gradually clamped within the two portions.

The roller assembly may also include a crimping roller set to further roll-form the two portions so that the end and the two portions are crimped together.

Each such folding set may also have a pair of rollers rotatable about a pair of parallel first axes, for gripping the strip and at least one forming roller. The forming roller may have an axis of rotation which is angularly disposed to the first axes, for bearing against a part of one of the portions.

The invention is now described, by way of examples, with reference to the accompanying drawings.

DETAILED DESCRIPTION OF THE DRAWINGS

Figures 1, 2, 3:
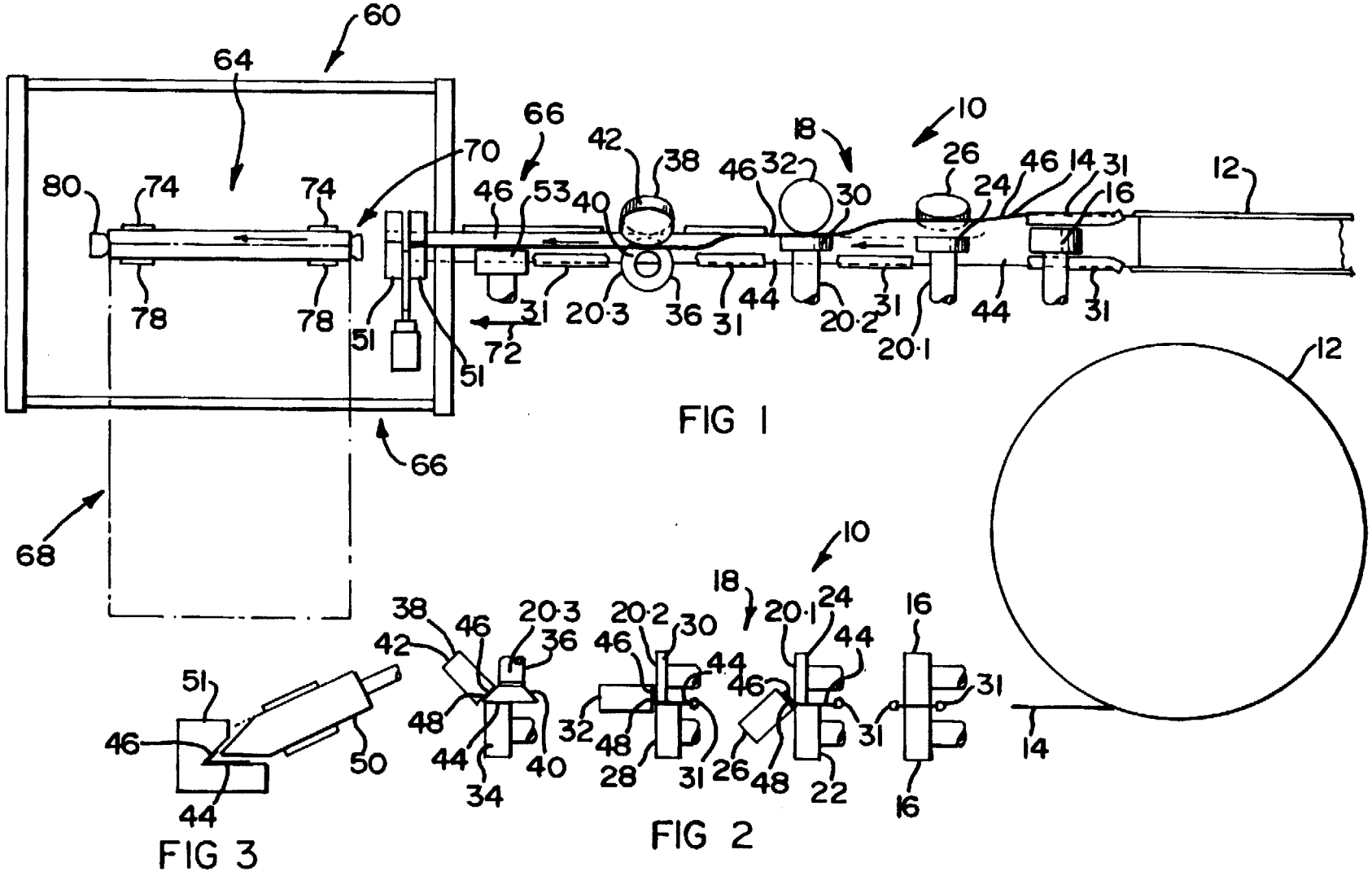
FIG. 1 shows a schematic plan view of an apparatus, in accordance with one aspect of the invention, for manufacturing a binding strip and an apparatus, in accordance with a further aspect of the invention, for securing the binding strip to a calendar.
FIG. 2 shows a schematic side view of the apparatus of FIG. 1.
FIG. 3 shows a schematic side view of a parting means of the apparatus of FIG. 1.

In FIG. 1, reference numeral 10 generally indicates a apparatus, in accordance with the invention, for manufacturing a binding strip.

The apparatus 10 includes a supply means in the form of a roll 12 of metal strip 14 and a pair of feed rollers 16. The rollers 16 serve to feed the strip 14 from the roll 12.

The apparatus 10 further includes a folding means which comprises a roller assembly 18. The roller assembly 18 includes a number of consecutively arranged roller sets 20. A first roller set 20.1 has a lower roller 22, an upper roller 24 and a forming roller 26. The lower roller 22 and the upper roller 24 are rotatable about a pair of parallel first axes. The forming roller 26 is rotatable about a second axis. The first axes are disposed at an angle of approximately 135° relative to the second axis.

A second roller set 20.2 has a lower roller 28 and an upper roller 30. The set 20.2 also has a forming roller 32. The rollers 28, 30 are both rotatable about a pair of parallel first axes. The forming roller 32 is rotatable about a second axis. The first axes are disposed at an angle of approximately 90° relative to the second axis.

The roller sets 20 include a third roller set 20.3. The third roller set 20.3 has a lower roller 34, an upper roller 36 and a forming roller 38. The lower roller 34 has an axis of rotation which is disposed at an angle of 90° to an axis of rotation of the upper roller 36. The forming roller 38 has an axis of rotation which is disposed at an angle of approximately 45° to the axis of rotation of the lower roller 34. The upper roller 36 has a frusto-conical rolling surface 40 which is complementary to a rolling surface 42 of the forming roller 38.

In use, the feed rollers 16 draw the metal strip 14 from the roll 12 into the sets 20.1, 20.2, 20.3 consecutively. The sets 20.1, 20.2 are oriented so that a first portion 44 of the strip 14 is received between the lower rollers 22, 28 and the upper rollers 24, 30. Edges of the first portion 44 are received in guides 31 to orient the strip 14 while the strip 14 is fed from the roll 12. A second portion 46 of the strip 14 has a surface 48 which bears against the forming rollers 26, 32. It will thus be appreciated that, as the strip 14 exits the second set 20.2, the first portion 44 will be disposed at an angle of approximately 90° relative to the second portion 46.

The third roller set 20.3 is oriented so that as the strip 14 exits the second roller set 20.2, the second portion 46 is drawn between the upper roller 36 and the forming roller 38. Thus, the second portion 46 is folded further so that the second portion 46 is disposed at an angle of approximately 45° relative to the first portion 44.

The apparatus 10 includes a fastening means for fastening an eyelet (not shown) to the strip 14, once the strip 14 exits the third set 20.3.

In FIG. 1, reference numeral 60 generally indicates an apparatus, in accordance with a further aspect of the invention, for securing the strip 14 to a calendar 62.

The apparatus 60 includes a crimping device 64 for crimping the strip 14 onto the calendar 62.

The apparatus 60 further includes a feed means 66, which defines a calendar feed path 68 and a binding strip feed path 70, the paths 68, 70 being located in the same plane. The feed means 66 serves to feed the calendar 62 and the binding strip 14 into the crimping device 64.

The apparatus 60 further includes a parting means in the form of a reciprocating cutter 50 which is slideably received between a pair of die blocks 51.

The feed means 66 includes a feed roller 53 for feeding the strip 14 towards the device 64 located downstream of the third roller set 20.3. In use, when a required length of the strip 14 is fed from the roller 53, the cutter 50 parts the strip 14 by moving relative to the die blocks 51.

The strip 14 is fed into the apparatus 60 in the direction of an arrow 72. The second portion 46 bears against a guide 74 while the portion 44 bears against a further guide 78.

The apparatus 60 includes a stop 80 against which an end of the strip 14 bears, to position the strip 14. The stop 80 has a sensor (not shown) operatively connected to the cutter 50 so that when the strip 14 bears against the stop 80, the cutter 50 parts the strip 14. The position of the stop 80 is adjustable so that the length of parted strip 14 can be varied.

As can be seen in FIGS. 4 to 9, the apparatus 60 includes a support member 84 and a pressure bar 86 which is displaceable relative to the support member 84. The support member 84 and the pressure bar 86 are oriented so that when the strip 14 is in position in the device 64, part of the first portion 44 rests on the support member 84 while the remainder of the first portion 44 rests on the pressure bar 86.

The apparatus 60 also includes a calendar feed guide 88 for guiding an end 90, to be bound, of the calendar 62, into a region 94 between the portions 44, 46 when the strip 14 is positioned.

A hammer bar 96 is located above the support member 84 and is displaceable towards and away from the support member 84. A crimping bar 98 is arranged adjacent the hammer bar 96 and has a crimping tool 100 which is oriented so that when the pressure bar 86 moves away from the support member 84, the crimping tool 100 is aligned with a gap 102 between the member 84 and the bar 86.

Figure 4:
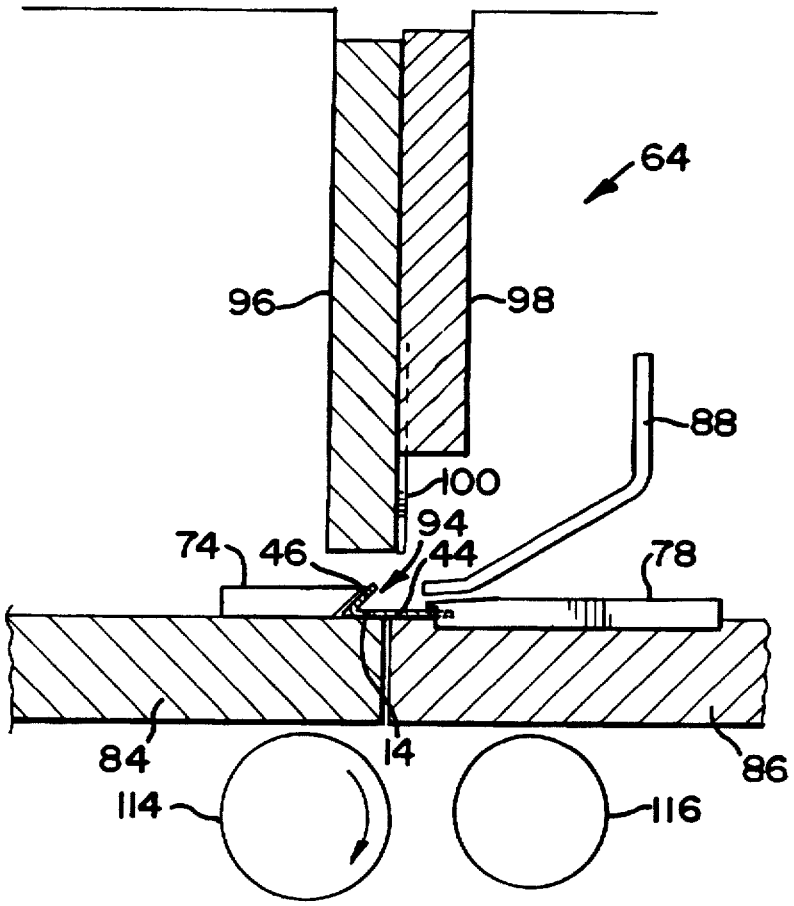
FIG. 4 shows a schematic sectioned side view of the apparatus for securing the binding strip to a calendar, in a first stage of operation.

In FIG. 4, there is shown a schematic sectioned side view of part of the apparatus 60 in a first stage of operation.

In this stage, the strip 14 has been positioned. The support member 84 and the pressure bar 86 are arranged adjacent each other to support the strip 14. Both the hammer bar 96 and the crimping bar 98 are in a raised position above the strip 14. The calendar feed guide 88 is in an operative position.

Figure 5:
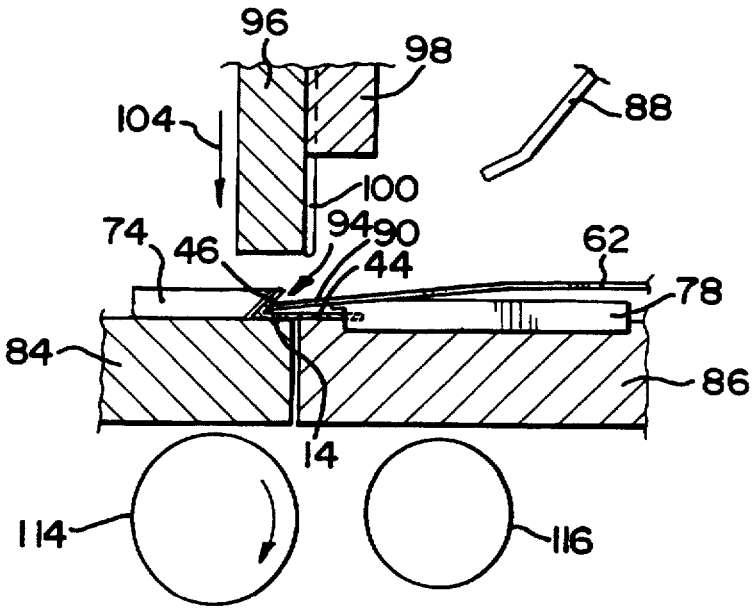
FIG. 5 shows the apparatus of FIG. 4 in a second stage of operation.

FIG. 5 shows the next stage of operation of the apparatus 60.

In this stage, the end 90 of calendar 92 is fed into the region 94 by means of the guide 88. The guide 88 is then displaced into an inoperative position. The hammer bar 96 begins a downward movement in the direction of an arrow 104.

Figure 6:
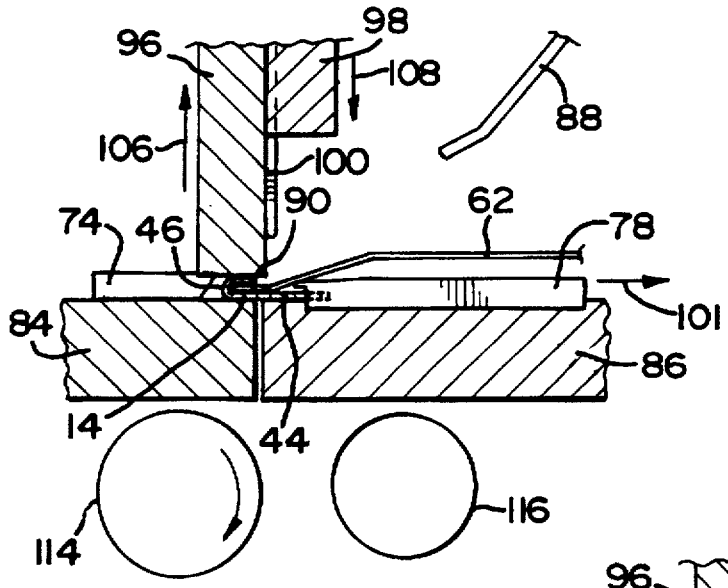
FIG. 6 shows the apparatus of FIG. 4 in a third stage of operation.

In FIG. 6, there is shown the next stage of operation of the apparatus 60.

In this stage, the hammer bar 96 has descended to bear against the surface 48 of the second portion 46 and to fold the second portion 46 towards the first portion 44 thereby clamping the end 90 between the portions 44, 46. The hammer bar 96 then moves in the direction of an arrow 106 towards an inoperative position. The crimping bar 98 then begins a downward motion in the direction of an arrow 108. At the same time, the pressure bar 86 moves away from the support member 84 in the direction of an arrow 101 to create the gap 102.

Figure 7:
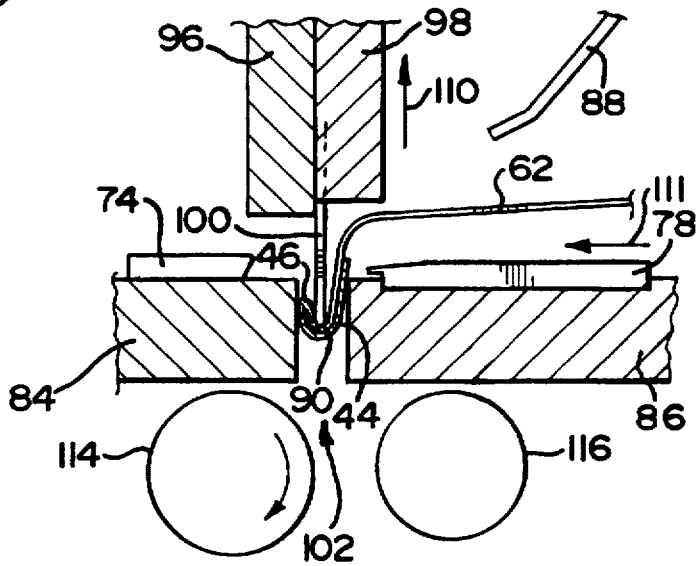
FIG. 7 shows the apparatus of FIG. 4 in a fourth stage of operation.

In FIG. 7, there is shown a further stage of operation of the apparatus 60.

In this stage, the crimping tool 100 bears down upon the end 90 adjacent the second portion 46. The tool 100 serves to drive the portions 44, 46 and the end 90 through the gap 102. The gap 102 is dimensionsed so that the portions 44, 46 and the end 90 are crimped together with the end 90 folded over within the portions 44, 46. The crimping bar 98 then begins an upward motion in the direction of an arrow 110. At the same time, the pressure bar 86 moves towards the support member 84 in the direction of an arrow 111.

Figure 8:
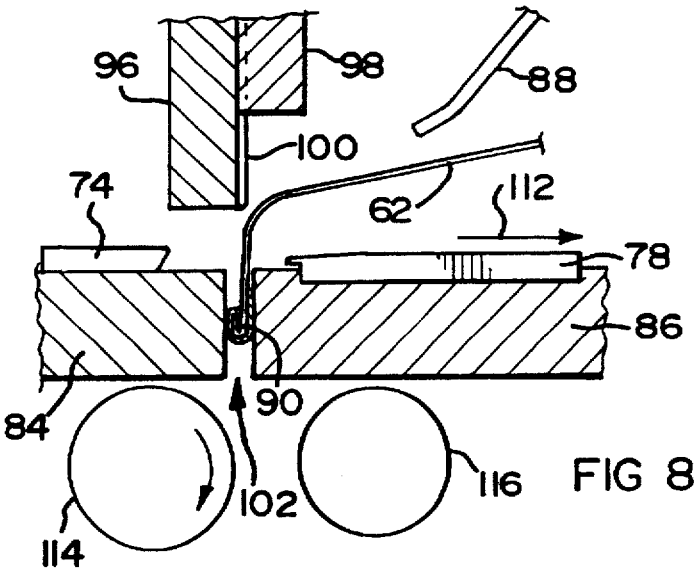
FIG. 8 shows the apparatus of FIG. 4 in a fifth stage of operation.

In FIG. 8, there is shown the next stage of operation of the apparatus 60.

In this stage, the pressure bar 86 has been moved towards the support member 84 to secure the crimped portions 44,46 and the end 90 together. The pressure bar 86 then begins a movement towards its inoperative position in the direction of an arrow 112.

Figure 9:
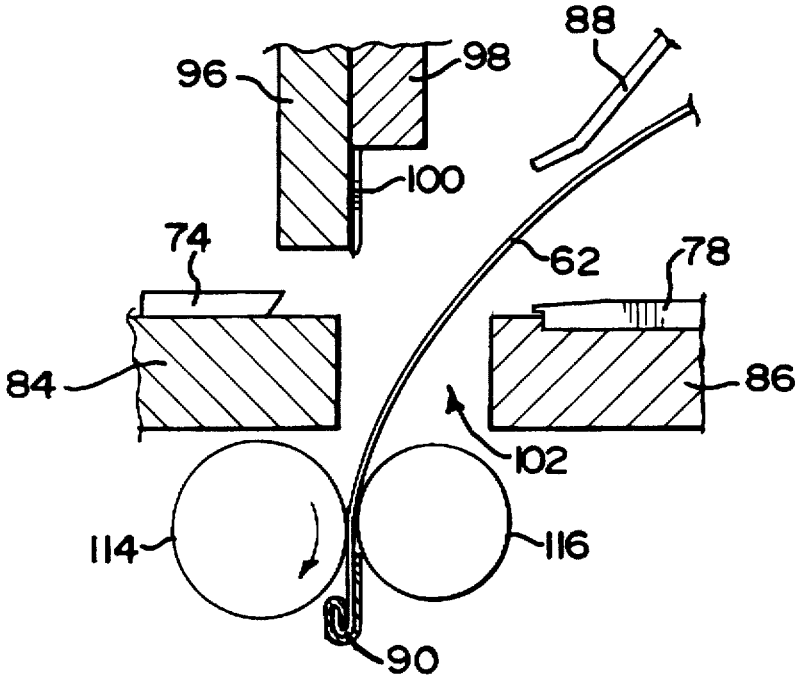
FIG. 9 shows the apparatus of FIG. 4 in a sixth stage of operation.

In FIG. 9, there is shown a final stage of operation of the apparatus 60.

At this stage, the pressure bar 86 has been displaced from the support member 84 so that the gap 102 is sufficiently wide to permit crimped portions 44,46 and the end 90 to drop through the gap 102. The crimped portions 44, 46 and the end 90 are received between a rotating roller 114 and an idling roller 116 to be drawn through the rollers 114, 116 towards a stacking region (not shown) where the bound calendars are stored.

Instead of the device 64, the apparatus 60 can include a further roller assembly to perform the crimping operation.

Figure 10:
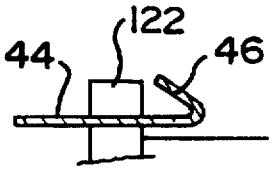
FIG. 10 shows a pusher bar of an apparatus for securing the binding strip to a calendar, in operation.
Figure 11:
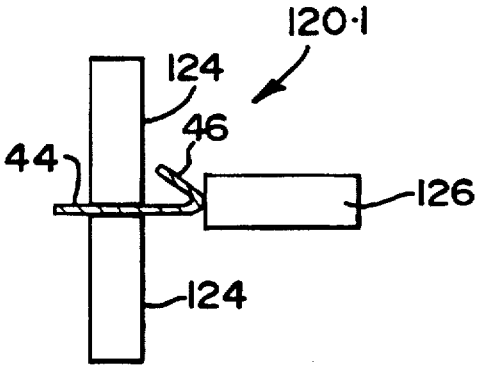
FIG. 11 shows a schematic front view of a first clamping roller set of a roller assembly of the apparatus.
Figure 12:
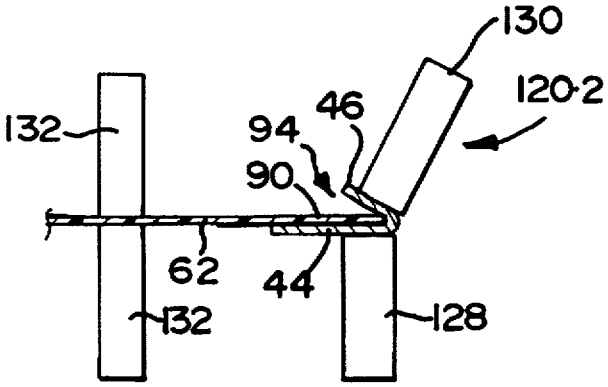
FIG. 12 shows a schematic front view of a second clamping roller set.
Figure 13:
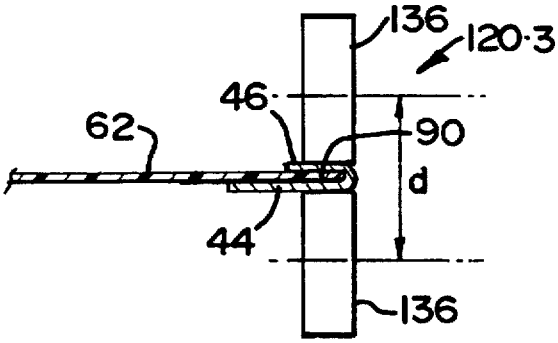
FIG. 13 shows a schematic front view of a third clamping roller set.
Figure 14:
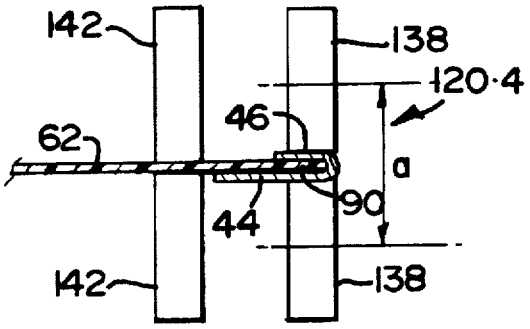
FIG. 14 shows a schematic front view of a fourth clamping roller set.

This further rolling assembly is divided into clamping roller sets and crimping roller sets. In FIGS. 11 to 14, reference number 120 generally indicates a clamping roller set. In FIGS. 15 to 21, reference numeral 150 generally indicates a crimping roller set. In FIG. 10 reference numeral 122 generally indicates a pusher bar in an operative position. With reference to FIGS. 1 to 9, like reference numerals refer to like parts, unless otherwise specified.

With this apparatus, once the metal strip 14 has been parted, the pusher bar 122 acts on one end of the parted strip 14 to feed the first portion 44 between a pair of drive rollers 124 of a first clamping roller set 120.1. The first set 120.1 includes a guide roller 126 which bears against a junction between the first portion 44 and the second portion 46 to facilitate correct positioning of the strip 14.

A second set 120.2 includes a lower roller 128 and an upper roller 130. The lower roller 128 rotates about a horizontal axis and bears against the first portion 44. The upper roller 130 has an axis of rotation which is angled so that the upper roller 130 bears against the second portion 46. The rollers 128, 130 to serve to grip the strip 14. At the same time, a feed mechanism, shown as a pair of feed rollers 132 serves to feed the end 90 of the calendar 62 into the region 94. The rollers 128, 130 therefore serve to prevent movement of the strip 14 as the end 90 is fed into the region 94.

A third set 120.3 includes a pair of rollers 136. The rollers 136 have parallel, horizontal axes and are positioned so that the portions 44, 46 are fed between the rollers 136. A distance "d" between the axes of the rollers 136 is such that the second portion 46 is bent towards the first portion 44 so that the portions 44, 46 are substantially parallel with the end 90 arranged between the portions 44, 46.

A fourth roller set 120.4 includes a pair of rollers 138. The rollers 138 also have parallel axes. A distance "a" between the axes is less than the distance "d" between the axes of the rollers 136. Thus, as the strip 14 moves from the rollers 136 to the rollers 138 the end 90 is clamped between the portions 44, 46.

The set 120.4 further includes a lower and upper rollers 142, the calendar 62 being received between the rollers 142 to position the calendar 62. It will be appreciated that, as the strip 14, formed in the assembly 10, moves through the first, second, third and fourth roller sets, the end 90 of the calendar 62 is clamped between the portions 44, 46.

In FIGS. 15 to 21, reference numeral 150 generally indicates a crimping roller set of the further assembly.

As can be seen in the drawings, the first portion 44 is wider than the second portion 46. Thus, when the second portion 46 is folded against the first portion 44, a part 153 of the first portion 44 extends beyond the second portion 46.

Figure 15:
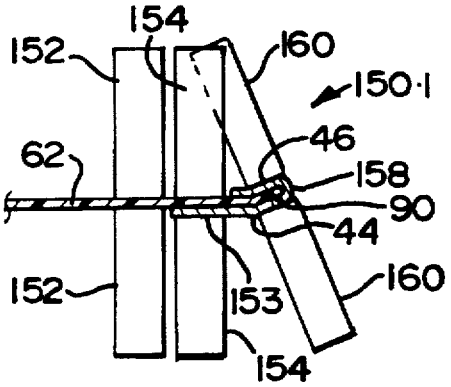
FIG. 15 shows a schematic front view of a first crimping roller set of the roller assembly.

In FIG. 15, reference numeral 150.1 generally indicates a first crimping roller set. The set 150.1 includes a pair of calendar rollers 152 for gripping the calendar 62 therebetween. A pair of rollers 154 grip the part 153 and the calendar 62. An end part 158 of the first and second portions 44, 46 is gripped between a pair of forming rollers 160. The forming rollers 160 each have an axis of rotation which is disposed at an angle of approximately 157.5° to the axis of rotation of the rollers 154, 156. Thus, the end part 158 is bent at an angle of approximately 157.5° to the remainder of the portions 44, 46.

Figure 16:
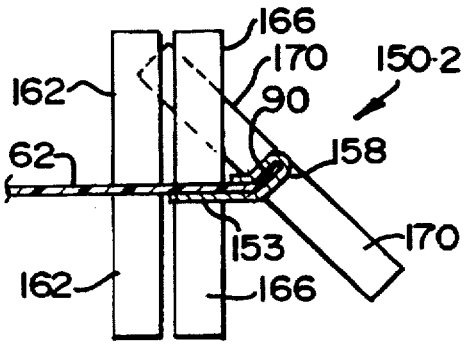
FIG. 16 shows a schematic front view of a second crimping roller set.

In FIG. 16, reference numeral 150.2 generally indicates a second crimping roller set.

The second set 150.2 includes a pair of calendar rollers 162 for gripping the calendar 62. Lower and upper rollers 166 are oriented in a similar position to the rollers 154 relative to the strip 14. A pair of forming rollers 170 each have an axis which is disposed at an angle of approximately 135° relative to the axis of rotation of the rollers 166. Thus, as the strip passes through the second set 150.2 the part 158 is bent at an angle of approximately 135° to the remainder of the strip 14.

Figure 17:
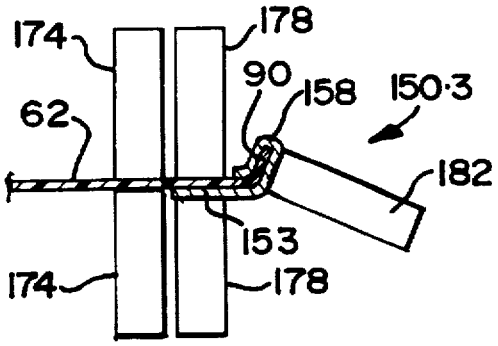
FIG. 17 shows a schematic front view of a third crimping roller set.

In FIG. 17, reference numeral 150.3 generally indicates a third crimping roller set.

The third set 150.3 includes calendar rollers 174 oriented in a similar position to the rollers 162 relative to the calendar 62 and lower and upper rollers 178 which are oriented in a similar position to the rollers 166 relative to the strip 14.

The third set 150.3 includes a single forming roller 182, which bears against the first portion 44 of the part 158. The roller 182 has an axis of rotation which is oriented approximately 112.5° relative to the axes of rotation of the rollers 178.

Thus, as the strip 14 and the calendar 62 pass through the third set 150.3, the part 158 is bent at an angle of approximately 112.5° with respect to the remainder of the strip 14.

Figure 18:
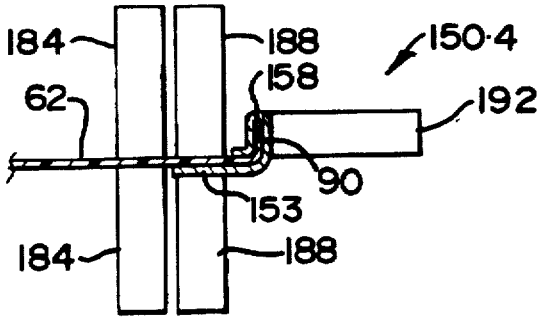
FIG. 18 shows a schematic front view of a fourth crimping roller set.

In FIG. 18, reference numeral 150.4 generally indicates a fourth roller set.

The fourth set 150.4 has calendar gripping rollers 184 and rollers 188. The rollers 184 are positioned similarly to the rollers 174. The rollers 188 are positioned similarly to the rollers 178.

The set 150.4 has a forming roller 192 which has an axis of rotation disposed at an angle of approximately 90° relative to the axis of rotation of the rollers 188. Thus, as the strip 14 and the calendar 62 pass through the fourth set 150.4, the part 158 is bent through approximately 90° relative to the remainder of the strip 14.

Figure 19:
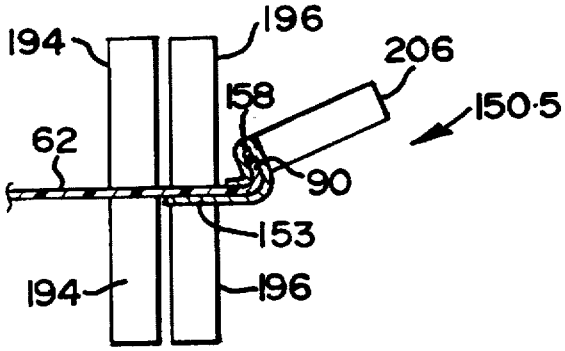
FIG. 19 shows a schematic front view of a fifth crimping roller set.
Figure 20:
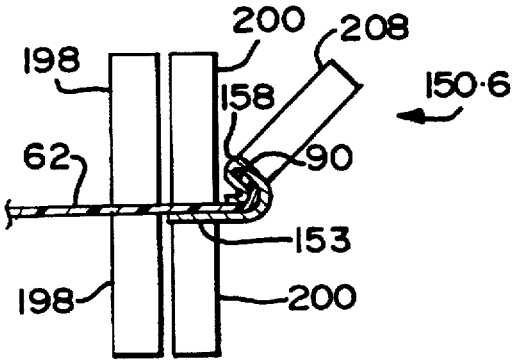
FIG. 20 shows a schematic front view of a sixth crimping roller set.
Figure 21:
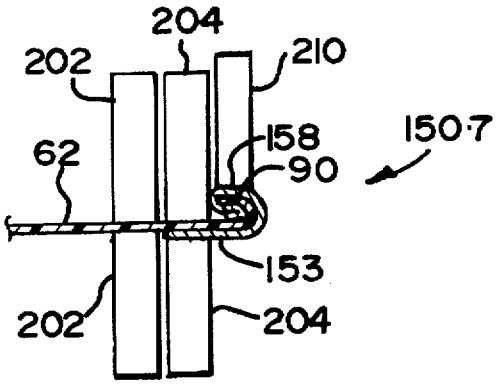
FIG. 21 shows a schematic front view of a seventh crimping roller set.

In FIGS. 19 to 21, reference numerals 150.5, 150.6, and 150.7 each refer to a fifth, sixth, and seventh roller set, respectively. Each of these sets 150.5, 150.6, 150.7 have calendar rollers 194, 198, 202 oriented similarly to the calendar rollers 184 and rollers 196, 200, 204 oriented similarly to the rollers 188. The fifth set 150.5 has a forming roller 206, the sixth set 150.6 has a forming roller 208, and the seventh set 150.7 has a forming roller 210. The forming roller 206 has an axis of rotation which is disposed at an angle of approximately 67.5° relative to the axis of rotation of the rollers 196. With the roller 208, the angle is approximately 45°.

The roller 210 has an axis of rotation which is substantially parallel to the axis of rotation of the roller 204.

In use, as the strip 14 and the calendar 62 pass through the sets 150.5, 150.6, 150.7, the part 153 is bent, in stages, through 67.5° to be substantially parallel to the remainder of the strip 14. This will result in the end 90 of the calendar 62 and the portions 44, 46 being crimped together.

Figure 22:
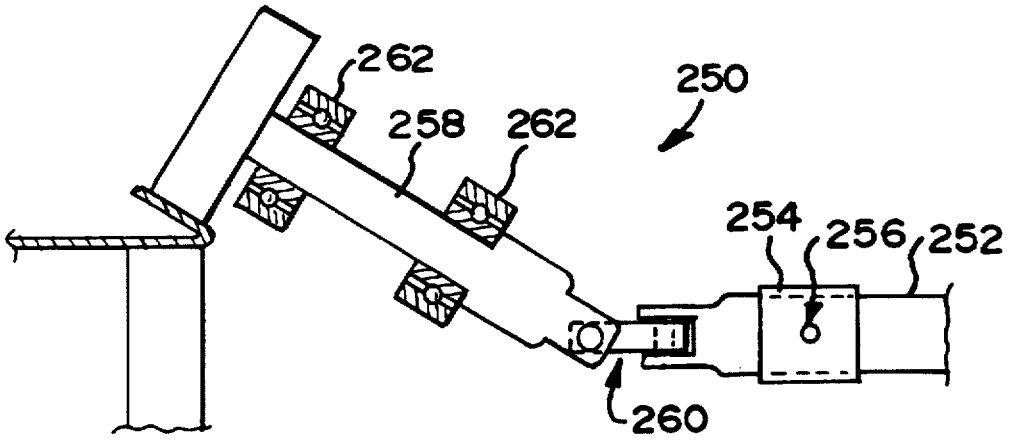
FIG. 22 shows a schematic front view of a drive mechanism for the rollers of a clamping roller set.

In FIG. 22, reference numeral 250 generally indicates a driving mechanism for driving the rollers of a set 120.

The mechanism 250 includes a drive shaft 252 supported in a bearing 254 having an orifice 256 for lubrication. The shaft 252 is connected to a roller shaft 258 via a universal joint 260. The roller shaft 258 is connected to a roller of a set 120. The shaft 258 is supported by ball bearings 262.

An advantage of utilising the metal strip 14 for binding calendars is that the strip 14 can be parted at any place to correspond with a width of the calendar 62. The result of this is that wastage of the strip 14 is inhibited.

Usually only two or three difference strip thickness are necessary to bind a large variety of calendars. It will thus be possible for a user to keep only two or three different roll thicknesses in stock and still be able to meet the majority of binding orders. Furthermore, storage of raw material will be facilitated.

We claim:

1. An apparatus for binding a calendar, the apparatus comprising:

a supply means for supplying metal strip from a roll thereof;

a first folding means for folding the length of metal strip about a first fold line parallel to a longitudinal axis thereof to form two portions angularly disposed to each other along the fist fold line to provide a channel in which an edge of the calendar is received;

a second folding means for folding the folded strip with the edge therein about a second fold line which is substantially parallel to the first fold line to provide two parts that are angularly disposed relative to each other along the second fold line;

a crimping means for crimping the two parts and the edge together; and a feed means, which defines a document feed path and a binding strip feed path, the document feed path and the binding strip feed path being located in the same plane, for feeding the edge of the calendar into the channel, for feeding the folded strip and the calendar with the edge therein to the second folding means, and for feeding the folded strip and the calendar to the crimping means.

2. The apparatus as claimed in claim 1, in which the first folding means comprises a first roller assembly.

3. The apparatus as claimed in claim 2, in which the first roller assembly includes a number of consecutively arranged roller sets, for successively folding the two portions in stages until the required angle between the two portions is obtained.

4. The apparatus as claimed in claim 3, in which each roller set has a pair of rollers rotatable about a pair of parallel first axes for gripping one of the portions and a forming roller, having an axis of rotation which is angularly disposed to the first axes, for bearing against a surface of the other portion.

5. The apparatus as claimed in claim 1, in which the supply means includes a roll of metal strip and a pair of feed rollers for feeding the strip from the roll into a first roller set.

6. The apparatus as claimed in claim 2, which includes a reciprocating cutter for parting the strip when a desired length of the strip has passed out of the first roller assembly.

7. The apparatus as claimed in claim 1, in which the second folding means includes a first portion of a second roller assembly.

8. The apparatus as claimed in claim 7, in which the first portion of the second roller assembly includes a number of consecutively arranged roller sets, for successively displacing the two parts towards each other until the required angle between the two parts is obtained.

9. The apparatus as claimed in claim 8, in which the feed means includes a document feed mechanism for feeding the end of the calendar into the channel prior to the portions being displaced towards each other.

10. The apparatus as claimed in claim 9, in which the crimping means includes a second portion of the second roller assembly, the second portion including a number of consecutively arranged crimping roller sets for roll-forming the two parts, with the edge of the calendar therebetween, in a number of stages so that the edge and the two parts are crimped together.

11. The apparatus as claimed in claim 10, in which each crimping set has a pair of rollers rotatable about a pair of parallel first axes for gripping the strip and at least one forming roller having an axis of rotation which is angularly disposed to the first axes, for bearing against one of the parts.

12. An apparatus for binding a calendar, the apparatus comprising:

a supply means for supplying a partially folded over metal binding strip having two portions angularly disposed about a first fold line;

a mating means for mating the binding strip and an edge of the calendar, with the end of the calendar located in a region between the portions; and a roller assembly which includes a number of consecutively arranged folding roller sets for folding the folded strip with the edge therein about a second fold line to provide two parts that are angularly disposed relative to each other along the second fold line, the roller assembly further including a number of consecutively arranged crimping roller sets for crimping the two parts and the edge together.

13. The apparatus as claimed in claim 12, in which the mating means includes a calendar feed mechanism for feeding the edge of the calendar into a region between the portions.

14. An apparatus for binding a calendar having at least one paper sheet with a top edge having a dimension corresponding to a width of the calendar, the apparatus comprising:

a supply station to receive and advance a leading edge of a roll of metal binding material;

a first folding station downstream from the supply station, the first folding station bending the metal binding material along a first fold line parallel to a longitudinal axis of the metal binding material to produce first and second generally planar portions being separated by an acute angle therebetween;

a calendar feed station downstream of the first folding station, the top edge of the calendar being inserted between the first and second portions of the metal binding material at the calendar feed station;

a cutting station downstream of the first folding station, the cutting station parting the metal binding material to a length corresponding to the width of the calendar to produce a binding for the calendar;

a second folding station downstream of the cutting station, the second folding station folding the first and second portions until they are generally parallel with each other and the edge of the calendar being sandwiched therebetween; and a crimping station downstream of the second folding station, the crimping station bending the first portion of the binding to produce two sections of the first portion which are generally parallel to each other and the edge of the calendar being folded into a generally "J" shaped configuration between the two sections and the binder being crimped into a generally "e" shaped configuration at the crimping station.

15. The apparatus of claim 14 wherein the second folding station comprises:

a first and second pair of rollers, each of the rollers of each of the pairs of rollers contacting one of the portions of the binding, the first pair of rollers being upstream from the second pair of rollers, each of the rollers of each pair of rollers having an axis of rotation wherein the axes of rotation for the rollers of the second pair of rollers are generally parallel to each other and the axes of rotation of the rollers of the first pair of rollers are non-parallel with respect to each other.

16. The apparatus of claim 14 wherein the crimping station further comprises:

a plurality of rollers in which each of the rollers contacts the first portion of the binding, the plurality of rollers being successively arranged with respect to each other in the downstream direction and each of the rollers having an axis of rotation, the axis of rotation of a first roller of the plurality of rollers and the axis of rotation of a last roller of the plurality of rollers each being generally parallel to the calendar, wherein the axis of rotation of each of the rollers intermediate the first and last roller forms a successively greater angle with respect to the calendar than a preceding upstream roller of the plurality of rollers of the crimping station.

17. The apparatus of claim 14 wherein the cutting station further comprises:

a reciprocating cutter for parting the binding material; and a die which cooperates with the reciprocating cutter to retain the first and second portions in position relative to each other while the binding material is parted.

* * * * *